US005915998A

United States Patent [19]

Stidham et al.

[11] Patent Number: 5,915,998

[45] Date of Patent: Jun. 29, 1999

[54] ELECTRICAL CONNECTOR AND METHOD OF MAKING

[75] Inventors: Curtis R. Stidham, Parma; David S. Flaherty, Lakewood; Robert G. McPherson, Aurora, all of Ohio

[73] Assignee: Erico International Corporation, Solon, Ohio

[21] Appl. No.: 08/666,010

[22] Filed: Jun. 19, 1996

[51] Int. Cl.[6] ..... H01R 11/09

[52] U.S. Cl. ..... 439/723; 439/798; 439/521

[58] Field of Search ..... 439/135, 282, 439/283, 521, 523, 586, 587, 798, 721, 723

[56] References Cited

U.S. PATENT DOCUMENTS

| | | | |
|---|---|---|---|
| 3,183,476 | 5/1965 | Sacks et al. | 439/798 |
| 4,241,975 | 12/1980 | Cooper, Jr. | 439/798 |
| 5,533,912 | 7/1996 | Fillinger et al. | 439/521 |

OTHER PUBLICATIONS

Pp. D2–1 through D2–8 ERITECH® ESP® catalog illustrating Underground Connectors—Cast, dated 1994.

*Primary Examiner*—Khiem Nguyen

*Attorney, Agent, or Firm*—Renner, Otto, Boisselle, Sklar

[57] ABSTRACT

A low resistance electrical connector comprising a flat bar having multiple lateral fingers projecting from the bar to form flat compression pads for attachment of electrical connectors, and an insulating housing surrounding said bar and including relatively short cylindrical projections enclosing a short extent of each finger and presenting a circular shoulder at the proximal end of each finger or the inner end of each compression pad so that a rocket may telescope over the shoulder and seal the connection to each pad. The number of fingers projecting from each bar may vary and they may project from one or both lateral sides of the bar. The connector is made by laser or waterjet cutting a flat sheet or bar of conductive metal such as copper, aluminum or a laminate to form a blank. The sheet is cut to avoid excessive scrap so that the space between fingers becomes the fingers of another blank. The blank is deburred and placed in a mold to form the insulating housing and cylindrical projections. Holes are drilled and tapped in the projecting pads either before or after molding.

13 Claims, 2 Drawing Sheets

ELECTRICAL CONNECTOR AND METHOD OF MAKING

This invention relates generally to an electrical connector and more particularly to a low cost submersible junction bus connector and to a method of making the connector.

BACKGROUND OF THE INVENTION

Typically, submersible junction connectors of the compression type are bars with fingered projections extending in one or both lateral directions forming flat pads or taps to which bolted electrical compression connections are made. The conductor extends through the small end of a flexible boot called a rocket which seals the connection and which has a large end which telescopes over and seals around an insulated annular or cylindrical shoulder. Thus the pad has to be bare, flat and smooth, while the adjacent shoulder is round and insulated. The pad clamping surface should also be eccentric with respect to the circular shoulder to allow room within the inscribed circle of the shoulder and thus the rocket for the connection and fasteners.

Such connectors have been made by the use of castings which are then machined to form the pads and shoulders. The insulation is usually applied by dip coating. Such connectors can also be made by machining blocks of aluminum or other conductive metal. Whether machining castings or blocks, the operations to make the flat, smooth surface on the fingers for a good low resistance electrical compression connection are exacting and expensive. It would be desirable if the manufacturing process could start with an already flat surface.

Many of the prior connectors are made of aluminum or other conductive metal and the cylindrical projections from which the multiple pads or taps are machined are entirely metal saved for the insulating dip coating. Such circular part may be the bulk of the metal and weight used in the connector.

Copper is sometimes preferred for electrical connections, but disadvantages of copper are its cost and weight. For more costly metals, excess metal in bulk should be avoided, particularly if it is heavy. Also, in prior connectors with machined pads or taps, there is no special relationship between the width of the pad and the lateral distance between the pads other than to allow room to make the connection and properly install the rocket.

It would be desirable if a compression connector could be made from flat metal such as copper sheet or lamina in an economical manner and still properly function and seal with the required rocket.

Junction bus connectors can also be made by welding, brazing, or even press fitting the fingers or pads into the central bus. Such connectors as well as comparable cast connectors exhibit an internal resistance which may lead to higher operating temperatures and higher electrical losses. This adversely affects the efficiency and useful life of the connector. It would accordingly be desirable to provide a junction bus connector with a lower internal resistance.

SUMMARY OF THE INVENTION

A submersible electrical connector is formed from flat metal conductive sheet, plate, or bar. Copper, aluminum, or lamina may be employed. The sheet is cut with a laser or waterjet to form blanks of spines with laterally projecting fingers. The fingers may project to one or both sides of the spine depending upon whether a single sided or double sided connector is to be made. The fingers may vary in number from as few as two to as many as eight or more. A typical connector may have four to six fingers. The fingers are spaced laterally from each other, with a gap slightly wider than the finger width. This allows the sheet or plate to be cut so that the normally scrap material is itself a blank having the configuration desired. The fingers are slightly narrower than the space between the fingers to allow for the kerf of the laser or waterjet cut and any deburring operation required.

The sheet blank is then placed in a two-part mold which closes about the blank with the fingers projecting outwardly. The mold parts close and seal about the proximal end of the fingers, with the majority of the finger sticking out. The mold parts have generally semi-cylindrical cavities. The closing rim of one mold part has recesses accommodating the projecting fingers and the other part clamps the fingers in such recesses. This positions one plane or surface of the blank at a diameter of the complete cylindrical mold cavity when the mold parts are closed. The mold cavity provides a cylindrical projection with a circular face shoulder over the root or proximal end of each finger. With the plate properly positioned and the mold closed, an insulating material such as ethylene propylene diene monomer (EPDM) is injected into the mold cavity. When at least partially cured, the mold is opened and the connector removed. The insulating material then forms a circular shoulder or face at the root or proximal portion of each finger over which the rocket is telescoped. The mold may produce an annular bead around the circular projection to cooperate as an O-ring with the interior of the rocket. The fingers exit the circular shoulder with one surface on the diameter and the other offset. A pair of holes are drilled and tapped in the projecting fingers either before or after molding to facilitate the attachment of a conductor lug to the finger pad or tap to make a high quality connector.

The resultant connector has improved internal resistance characteristics which result in lower operating temperatures and lower electrical losses. This translates to a more efficient connector having a longer useful life.

To the accomplishment of the foregoing and related ends, the invention then comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
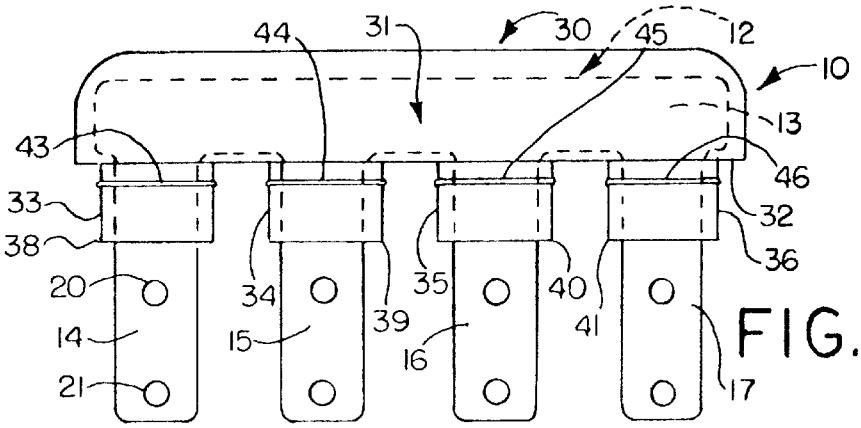
FIG. 1 is a top plan view of one form of connector in accordance with the present invention.
Figure 2:
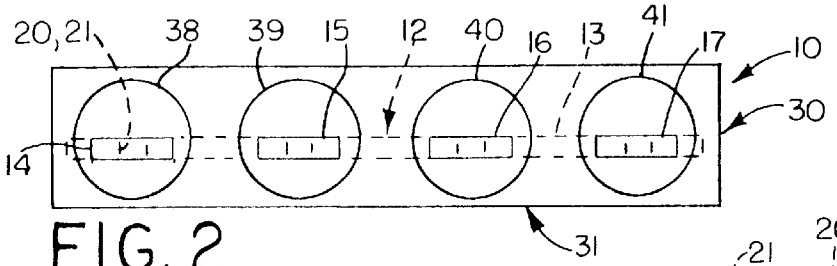
FIG. 2 is an elevation of the connector as seen from the bottom of FIG. 1.
Figure 3:
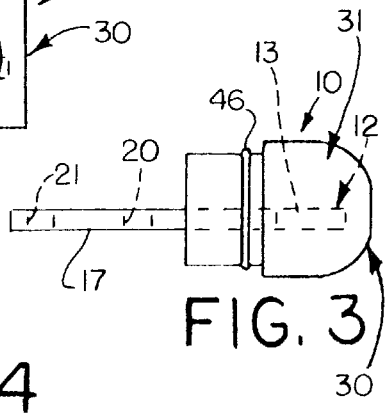
FIG. 3 is a side elevation of the connector as seen from the right hand side of FIG. 2.

Referring initially to FIGS. 1–3, there is illustrated one form of connector in accordance with the present invention. The connector is shown generally at 10, and comprises a flat blank shown generally at 12 which includes a flat spine or bar 13 having laterally projecting fingers 14, 15, 16, and 17. Thus the fingers project laterally from the spine and each projecting finger is provided with two tapped holes seen at 20 and 21 which enables a lug of a conductor to be bolted thereto as hereinafter described. The connector illustrated, as to the number of laterally projecting fingers is typical, and it will be appreciated that the number of fingers may vary from as few as two to as many as eight or more.

The connector of FIGS. 1–3 also includes an insulating casing shown generally at 30 which encloses the spine 13 with its main body portion 31 which includes projecting from its front face 32 cylindrical projections 33, 34, 35 and 36. These projections encase the proximal ends of the fingers 14, 15, 16, and 17, respectively. Each projection forms a circular shoulder as seen at 38, 39, 40, and 41, from which the bare fingers 14, 15, 16, and 17 project. Thus the distal ends of such fingers are flat and bare, not covered by the insulating material. It is the projecting fingers which form the flat compression pads or taps for the connection of conductors.

As seen more clearly in FIGS. 2 and 3, the top or upper surface of the compression pads provided by the bare projecting fingers are disposed diametrically with the circle of the shoulders, which encase the proximal end of each finger. Each projection near the face 32 is provided with an annular bead as seen at 43, 44, 45, and 46, respectively. As hereinafter described, such beads act as O-rings to form a seal with the rocket.

Figure 4:
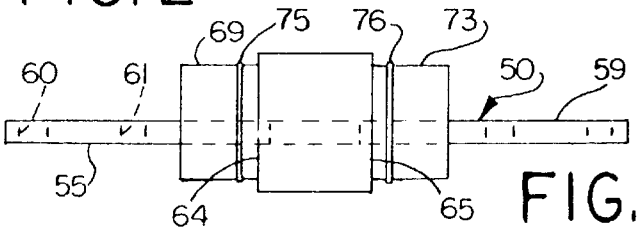
FIG. 4 is a side elevation of another form of connector.
Figure 5:
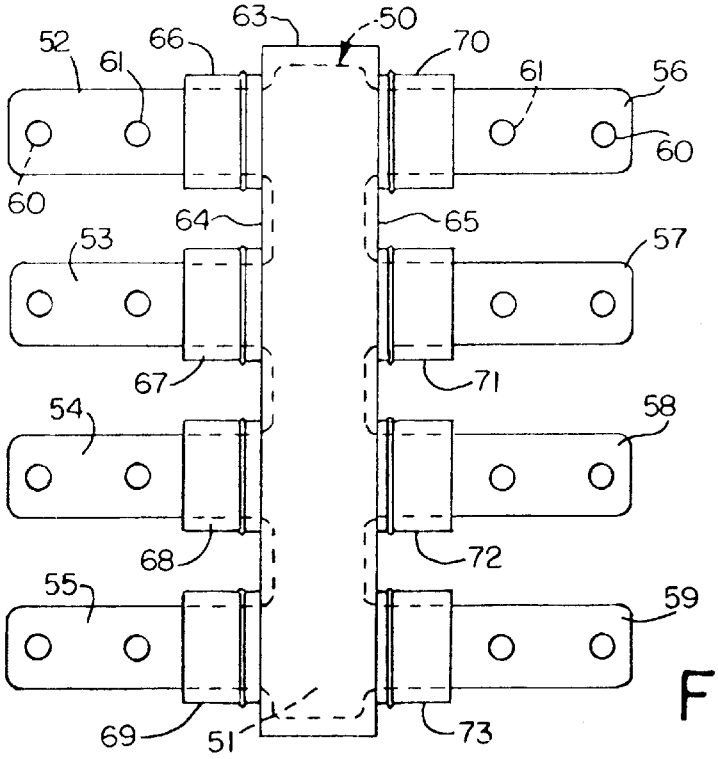
FIG. 5 is a top plan view of the connector seen in FIG. 4.

While FIGS. 1–3 illustrate a single sided four position connector, FIGS. 4 and 5 illustrate a double sided four position connector. The connector of FIGS. 4 and 5 comprises a flat metal blank shown generally at 50 which includes a central flattened spine or bar 51 with laterally projecting fingers on each side. The fingers on the left hand side of FIGS. 4 and 5 are shown at 52, 53, 54, and 55, respectively, while the fingers on the right hand side are shown at 56, 57, 58, and 59. Each finger is provided with two tapped holes seen at 60 and 61 so that a compression connection can quickly be made to the bare exposed surface of such fingers.

The connector 50 also includes an insulating casing 63 which has parallel side walls 64 and 65 from which project circular shoulders forming projections 66, 67, 68, 69, 70, 71, 72, and 73 for the fingers 52 through 59, respectively. Each projection is provided with an annular O-ring-like bead as seen at 75 and 76 in FIG. 4 relatively close to the casing faces 64 and 65. Like the connector of FIGS. 1–3, the flat metal blank is offset with respect to the circular face of the shoulders formed by the projections so that the upper surface of each of the projecting fingers as seen in FIG. 4 is on a diameter of the circular face of the respective projection.

The insulating casing is preferably made of an elastomeric material such as an EPDM while the blank forming the bus bar and the projecting fingers is made of a flat or planar sheet of copper, aluminum, or a conductive lamination.

Figure 6:
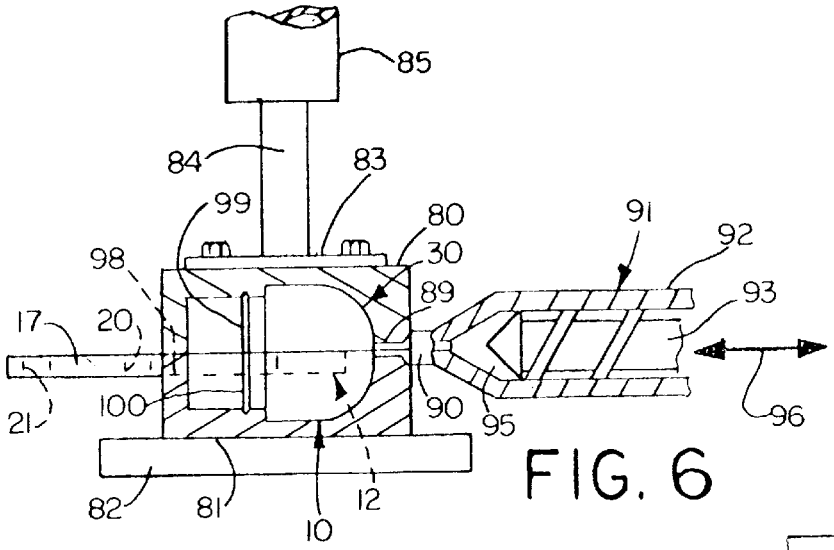
FIG. 6 is a schematic vertical section through the assembly mold in the molding process.
Figure 8:
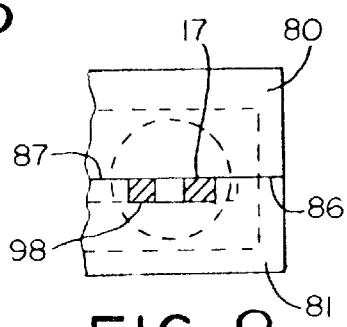
FIG. 8 is a front elevation of the mold assembly as seen from the line 8—8 of FIG. 7.
Figure 7:
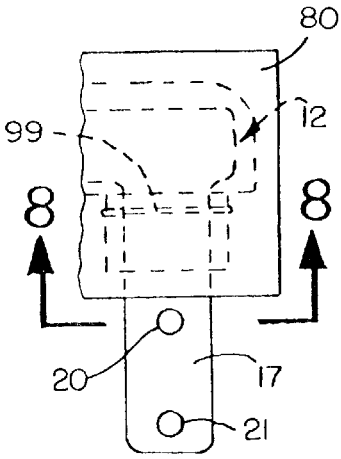
FIG. 7 is a fragmentary plan view of the mold assembly.

Referring now to FIGS. 6–8, there is illustrated schematically the mold assembly for providing the casing 30 for the embodiment of the connector shown in FIGS. 1–3. The process utilizes an upper mold part 80 and a lower mold part 81. The mold parts may be mounted in a press or clamp with the lower part 81 situated on fixed base 82, while the upper mold part is secured to platen 83 mounted on the rod 84 of clamp piston-cylinder assembly 85. As seen more clearly in FIG. 8, the mold parts when closed have abutting parting faces seen at 86 and 87, respectively, which is normally at the mid-point or about which the cavity is symmetrical.

As seen in FIG. 6, on the right hand side of the mold as illustrated, the parting faces are provided with a sprue opening 89 which receives the tip 90 of injection molding machine shown generally at 91. The machine typically includes a heated barrel 92 and a reciprocating screw 93 which heats and plasticizes the elastomer in the chamber 95. As the screw rotates, it retracts to the right hand side of FIG. 6 and then moves forward or to the left for injection as indicated by the double arrow 96. The injection occurs after the blank 12 has been placed in the mold and the mold parts closed.

In order to accommodate the fingers of the blank, each parting plane 86 of the mold part 81 is provided with a closely fitting recess seen at 98 in FIG. 6. The blank is thus positioned in a bottom mold part when the mold parts are opened with the fingers seated in the notches 98 and projecting beyond the mold part. The position of the blank may be controlled by a suitable gauge, not shown. The mold parts are then closed and the parting plane surface 86 of the upper mold part 80 clamps against the top of the projecting finger. The mold parts upon injection then form the complete casing which includes the projecting circular shoulders enclosing the proximal end of each finger and including the annular ridge or bead which is formed by the semi-circular grooves 99 and 100.

After the encasement is molded to form the insulation with the annular sealing shoulders at the proximal end of each finger, the insulation is at least partially cured before the mold is opened and the connector removed from the mold. If desired, post heating may be employed to accelerate the cure. Otherwise, the connector will complete its cure at room temperature.

Figure 9:
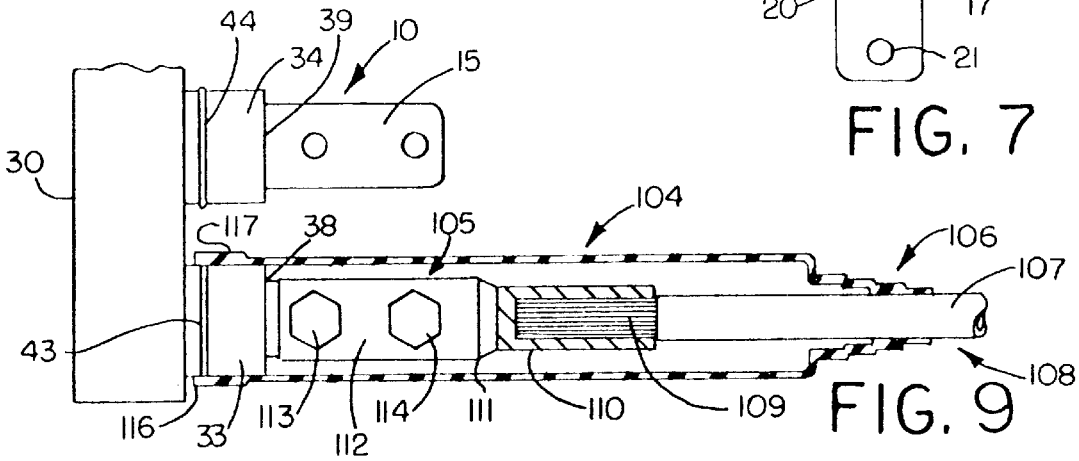
FIG. 9 is a fragmentary top plan view partially in section of a connection with a rocket in place.

Referring now to FIG. 9, there is illustrated a rocket at 104 which encloses and seals the electrical compression connection shown generally at 105. The rocket includes a smaller stepped end 106 designed tightly to girdle the insulation 107 of conductor 108. The conductor bare end 109 of the conductor is secured in tubular sleeve 110 of lug 111. The conductor may be secured to the lug by soldering, brazing, welding, or crimping, for example. The lug includes a flat pad 112 and the flat pad is secured to the bare pad of the exposed finger by the fasteners 113 and 114. When the fastener are tightened, a good compression connection is made and the rocket is then slid to the left as seen so that its larger end or mouth 116 which has a slightly increased wall thickness 117 telescopes over the shoulder 38 of the projection 33. The ridge 43 engages the elastic interior of the mouth 116 acting as an O-ring seal. With the rocket in position as shown in FIG. 9, a high quality yet low cost submersible compression electrical connection is made.

Figure 10:
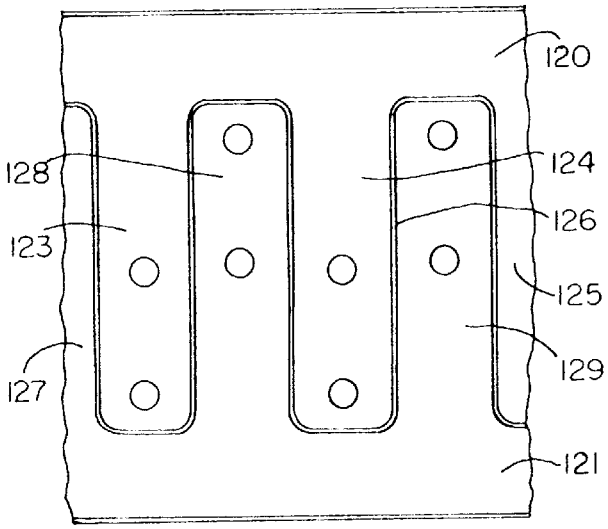
FIG. 10 is an enlarged fragmentary view of two blanks being formed concurrently.

Referring to FIG. 10 and back to FIGS. 1 and 5, it will be noted that when the blank is formed from the flat or planar conductive material, the distance between adjacent fingers is slightly wider than the fingers themselves. The dimensional variation is to allow for cutting of the blank material and subsequent deburring. In this manner, two adjacent blanks shown at 120 and 121 in FIG. 10 may be formed at the same time by the cutting operation with minimal scrap or waste in the process. The cutting operation is preferably performed by a programmed laser or waterjet cutter. In any event, as the fingers 123, 124, and 125 of the blank 120 are cut at the kerf 126, so are the fingers 127, 128, and 129 of the blank 121, and thus two blanks are being formed simultaneously. After the blank is deburred, it may be tinned or tin plated to minimize corrosion and help maintain a low resistance connection between the compression pad and lug.

As can now be seen there is provided a low cost, yet high quality low resistance submersible electrical connector which is made by blanking a flat sheet of conductive metal to form a bar or spine blank having a plurality of laterally projecting fingers. The blank may be tin coated then inserted into a mold to encase the bar in insulation while leaving the fingers bare to form compression pads. As the insulation is molded onto the blank, the insulation is formed to provide annular sealing shoulders at the proximal end of each finger. After the insulation is cured, an electrical connection is made by clamping to the finger pad and simply telescoping the rocket over the annular shoulder formed thus completely enclosing and sealing the electrical connection made.

We claim:

1. A submersible electrical connector comprising a flat sheet bar having laterally projecting fingers forming flat pad compression connection surfaces, and an insulating casing surrounding said bar, but leaving a portion of said fingers exposed, said casing including a cylindrical projection encasing the proximal end of each finger and forming a cylindrical shoulder to seal a rocket thereon to enclose and seal the connections.

2. A connector as set forth in claim 1 wherein each finger includes opposite flat surfaces, one of which forms a diameter of the cylindrical projection and shoulder and said flat pad compression connection surface in the middle of the shoulder.

3. A connector as set forth in claim 2 including an annular bead on said cylindrical projection to act as an O-ring against the interior of the rocket.

4. A connector as set forth in claim 1 wherein said flat bar has fingers projecting to only one side thereof.

5. A connector as set forth in claim 1 wherein said flat bar has fingers projecting to both sides thereof.

6. A connector as set forth in claim 1 including a conductor with a lug clamped to said pad.

7. A connector as set forth in claim 6 including a rocket enclosing the connection sealed around the conductor at one end and around the projection and shoulder at the other end.

8. An electrical compression connector comprising a flat sheet bar having multiple lateral fingers forming flat pad compression style electrical connection surfaces, and an insulated casing over said bar including projecting shoulders encasing the proximal end of each finger, the respective finger beyond the shoulder forming the compression pad, and means to seal a rocket to the respective shoulder when a compression connection is made.

9. A connector as set forth in claim 8 wherein said shoulders are circular and are at the ends of short cylindrical projections.

10. A connector as set forth in claim 9 wherein each finger includes opposite flat surfaces, one of which forms a diameter of the cylindrical projection and shoulder and said flat pad compression connection surface in the middle of the shoulder.

11. A connector as set forth in claim 10 including an annular bead on said cylindrical projection to act as an O-ring with regard to the interior of the rocket.

12. A connector as set forth in claim 11 including a conductor with a lug clamped to said pad.

13. A connector as set forth in claim 12 including a rocket enclosing the connection sealed around the conductor at one end and around the projection and shoulder at the other end.

* * * * *